US007712688B2

(12) United States Patent
Priester

(10) Patent No.: US 7,712,688 B2
(45) Date of Patent: May 11, 2010

(54) COMMINUTING APPARATUS, ESPECIALLY DOCUMENT SHREDDER

(75) Inventor: Wolfgang Priester, Balingen (DE)

(73) Assignee: Krug & Priester GmbH & Co. KG, Balingen (DE)

( * ) Notice: Subject to any disclaimer, the term of this patent is extended or adjusted under 35 U.S.C. 154(b) by 582 days.

(21) Appl. No.: 10/586,986

(22) PCT Filed: Jan. 15, 2005

(86) PCT No.: PCT/EP2005/000368

§ 371 (c)(1),
(2), (4) Date: May 7, 2007

(87) PCT Pub. No.: WO2005/070553

PCT Pub. Date: Aug. 4, 2005

(65) Prior Publication Data

US 2007/0215728 A1 Sep. 20, 2007

(30) Foreign Application Priority Data

Jan. 22, 2004 (DE) ..... 20 2004 000 907 U

(51) Int. Cl.
*B02C 18/22* (2006.01)

(52) U.S. Cl. ..... 241/37.5; 241/100

(58) Field of Classification Search ..... 241/37.5, 241/100

See application file for complete search history.

(56) References Cited

U.S. PATENT DOCUMENTS

| | | | | |
|---|---|---|---|---|
| 1,066,722 A * | 7/1913 | Ganzhorn | ..... | 241/37.5 |
| 2,899,140 A * | 8/1959 | Hellyer | ..... | 241/190 |
| 5,429,313 A | 7/1995 | Schwelling et al. | | |

FOREIGN PATENT DOCUMENTS

| | | |
|---|---|---|
| DE | 296 02 262 | 3/1996 |
| GB | 2 171 029 | 8/1986 |
| JP | 06000405 A * | 1/1994 |

* cited by examiner

*Primary Examiner*—Faye Francis
(74) *Attorney, Agent, or Firm*—Friedrich Kueffner

(57) ABSTRACT

A comminuting apparatus, particularly a document shredder, having an approximately funnel-shaped feeding area for the material that is to be comminuted. A flap is provided to constrict the feeding area to a narrow feeding path and extends across the width thereof. The flap is pivotally and/or movably mounted in the feeding area.

11 Claims, 3 Drawing Sheets

COMMINUTING APPARATUS, ESPECIALLY DOCUMENT SHREDDER

Figure 1:
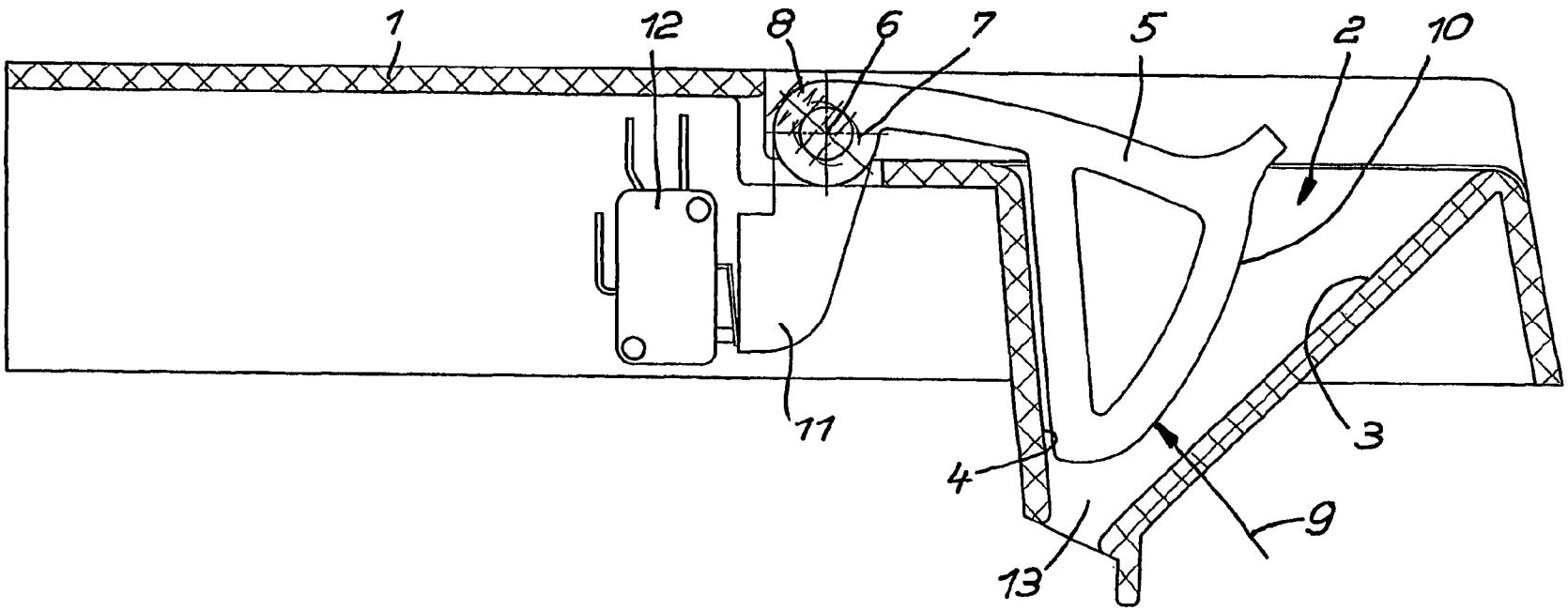

The invention relates to a comminuting apparatus, especially a document shredder with an approximately funnel-shaped feeding area for the material that is to be comminuted. Since these devices are in ever wider circulation and are used not only in offices but also in rooms heavily frequented by the public including children as well, it is desirable that the devices exhibit a safety standard that extends beyond the minimum requirements. The object of the invention is therefore to increase the device safety on the one hand, while keeping the apparatus easy to use on the other.

This object is met according to the invention in that a flap which constricts the feeding area to a narrow feeding path and extends across the width thereof is pivotally and/or movably mounted in the feeding area of the comminuting apparatus. In this way, unauthorized persons are prevented from reaching into the actual feed and the danger of injury is mostly prevented as a result. This additional safety measure is attained without complicating the operation in any way. In addition, the functions do not change at all if the transport of the material to be comminuted is reversed, since the flap swings back by itself and the material to be comminuted can exit unimpededly.

Inasmuch as the material. to be comminuted thickens by bulging, folding or the like while being fed, an increase in the clamping arises from the friction of the material to be comminuted on the corresponding surface of the flap, but by no means an unwanted opening thereof. According to a further embodiment of the invention, the flap is pivotable into a position which unblocks the feeding area, so that one obtains unobstructed access to the cutting unit inlet if necessary. The support surface for the material to be comminuted extends preferably parallel or in a sharp angle to the opposing flap surface in the direction toward the inlet.

According to a further embodiment of the invention, the rotational axis of the flap is located in the upper part of the feeding area or above it. Its alignment behind and above the surface opposite the support surface of the feeding area is particularly advantageous. The rotational axis of the flap is preferably mounted in an elongated hole which extends for example perpendicularly to the support surface of the material to be comminuted and is movable against the elastic force in the opposite direction relative to the support surface, in order to act on a switchgear for turning off a drive in this way, which represents a heightened safety feature. In this way, a crushing of finger tips or hands is prevented as a result of incorrect handling when feeding the material to be comminuted. Namely, as soon as the rotational axis of the flap exceeds a certain displacement path and with it a preset load, the drive of the comminuting apparatus is thereby turned off at least in the forward direction by means of a switchgear.

For safety reasons the flap is also connected to an additional switch which turns off the forward drive when the flap is lifted. The switchgear can also be designed such that it reacts to rotation as well as to displacement. In this way, injuries are prevented resulting from an unauthorized tampering with the apparatus.

For emptying the cutting unit however it may be necessary to conduct a forward motion with a lifted flap. An additional switchgear is provided for this purpose, particularly a push-button switch which actuates a brief switch pulse with which the forward and reverse drive can be conducted even when the flap is lifted. As a further safeguard, an additional electronic switchgear can be arranged which especially acts to prevent hysteresis mistakes and which turns off the entire drive and not only the forward drive when the flap is pivoted fully upwards.

Figure 2:
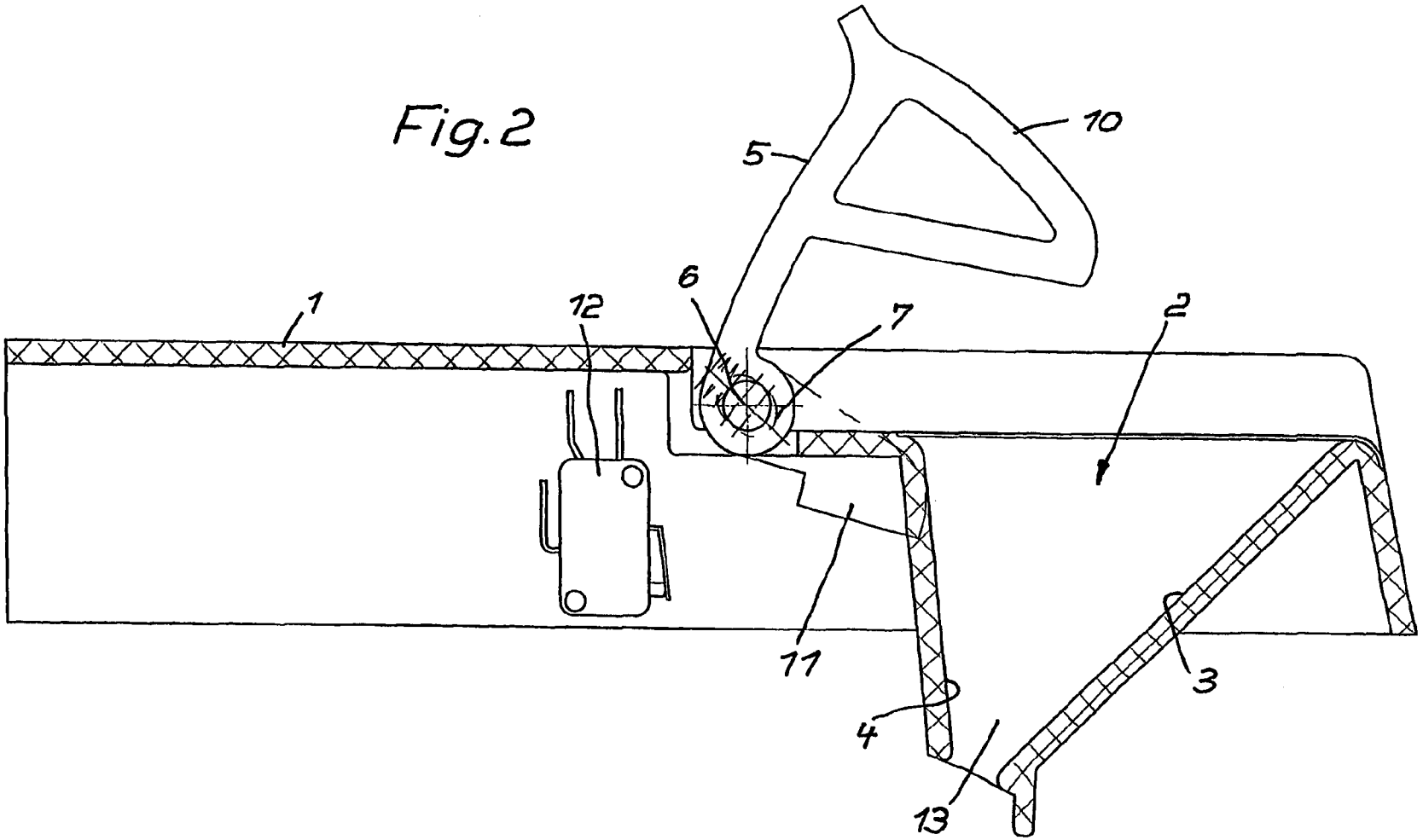
Figure 3:
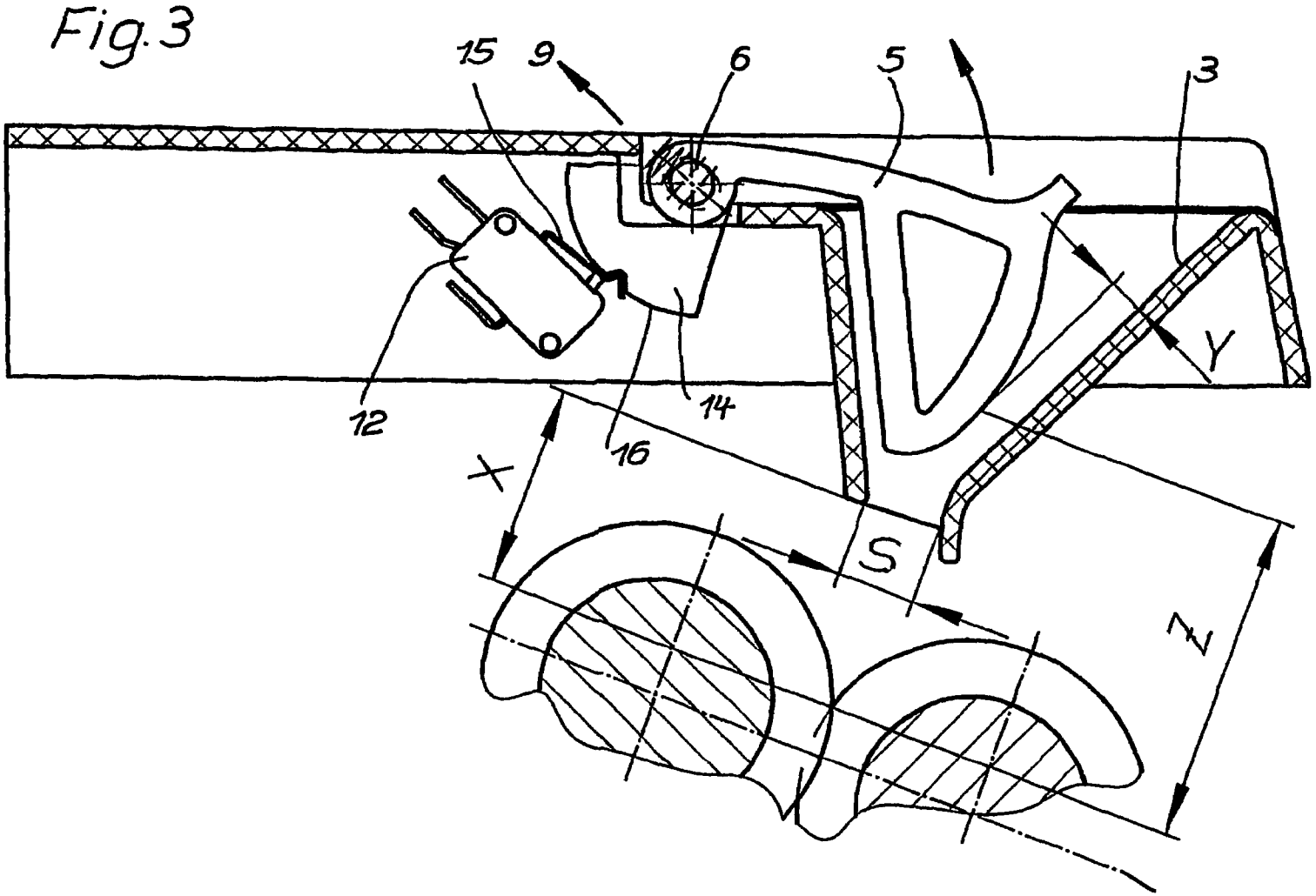

The drawing shows an embodiment of the invention as follows:

FIG. 1 is a cross-section of the upper part of the document shredder with an uncut flap located in a lower position, FIG. 2 is a drawing according to FIG. 1 with a flap located in an upper position, FIG. 3 is a drawing according to FIG. 1 of another embodiment with a cropped cutting unit shown schematically.

The upper part 1 of an otherwise not shown document shredder is provided with a funnel-shaped feeding area 2. This feeding area is constricted by the support surface 3 for the material to be comminuted which is also not shown and the opposing surface 4. A flap 5 is located in the feeding area 2 which is rotatably mounted around an axis 6. This flap is located behind and above the opposing surface 4 and is mounted in a elongated hole 7 extending perpendicularly to the support surface 3 and longitudinally movable against the load of a spring 8 in the direction of arrow 9 by a certain measure.

The surface 10 of the flap 5 located opposite the support surface 3 is convexly shaped and forms a sharp angle with the support surface 3, so that a constricted feeding path 13 results. As shown in FIG. 2, the flap 5 can be rotated upwards, wherein the feeding area 2 is completely cleared, so that, if necessary, one has access to the cutting unit not shown.

The flap 5 exhibits an arm 11 protruding over the rotational axis 6 and extending approximately parallel to its surface 10, which interacts with a switch 12. The switch 12 acts together with the drive of the document shredder, not shown, and is closed in the position of flap 5 according to FIG. 1, so that the drive is switched on. As soon as the flap 5 is pivoted upwards, it releases the switch 12 which interrupts the drive, so that one can safely reach into the feeding area 2.

The rotational axis 6 acts on a further switchgear which is not shown. If, for example, too much material to be comminuted is fed into the feeding area 2 or a foreign material or the finger of a hand accidentally gets caught under the flap 5, the pressure against the flap 5 is first increased until the flap and with it its rotational axis 6 shifts against the force of the spring 8 in the direction of arrow 9. As soon as a certain path and thus a preset tension is surpassed, the switchgear is then activated, so that the drive is suspended at least in forward direction in this way.

A circular segment-shaped arm 14 is provided instead of the arm 11 in the embodiment according to FIG. 3. The switch 12 is thereby approximately aligned in the direction of arrow 9 and the control lever 15 abuts the outer edge 16 of the circular segment 14. Consequently, the control lever 15 of the switch 12 is operated when swinging up the flap 5 as well as when shifting the flap in the direction of arrow 9.

In addition, the dimensional dependencies are illustrated in FIG. 3. X in this regard denotes the allowable required contact path according to the standard to the hazard area in the cutting unit 17, S is the allowable required opening width of the feeding path 13 according to the standard, and Y is an additional safety measure. The flap 5 should be designed such that the measure Z is bigger than the measure X.

The invention claimed is:

1. A document shredder, comprising: an approximately funnel-shaped feeding area for material that is to be shredded; a flap movably arranged in the feeding area, the flap extending across a width of the feeding area and being movable upwardly by the material to be shredded from a lower outlet position to a raised position, the flap being movable into a raised position when a flow of the material to be shredded is reversed and in the lower position constricts the feeding area to a narrow feeding path having a width that is smaller than an open width of the feeding area and smaller than when the flap is in the raised position; and a switch connected to the flap so that when the flap is in the raised position the switch turns off a forward drive.

2. The document shredder according to claim 1, wherein the flap is pivotally mounted in the feeding area.

3. The document shredder according to claim 2, wherein the rotational axis of the flap is pivotally mounted in an elongated hole which extends substantially perpendicularly to the support surface of the material to be comminuted and is movable against a spring force in a direction opposite to the support surface.

4. The document shredder according to claim 3, wherein the rotational axis of the flap actuates a switchgear which turns off a drive when a certain force or a certain displacement path is exceeded.

5. The document shredder according to claim 1, wherein the flap has a surface located opposite a support surface for the material to be comminuted, the flap surface extending parallel or at a sharp angle to the support surface toward a material feed direction.

6. The document shredder according to claim 2, wherein the flap has a rotational axis located in an upper part of the feeding area or above the feeding area.

7. The document shredder according to claim 6, wherein the rotational axis of the flap is arranged behind and above a surface opposite the support surface of the feeding area.

8. The document shredder according to claim 1, and further comprising an electric switchgear which turns off a drive in forward operation when the flap is pivoted upwards.

9. The document shredder according to claim 8, and further comprising a touch contact for bridging the switchgear.

10. The document shredder according to claim 8, and further comprising a contact switch which produces a temporary switch pulse both in a forward and reverse direction for switching the switchgear.

11. The document shredder according to claim 1, wherein the flap is pivotally mounted in the feeding area.

* * * * *